US006957647B2

(12) United States Patent
Evans et al.

(10) Patent No.: US 6,957,647 B2
(45) Date of Patent: Oct. 25, 2005

(54) PORTABLE BOW PRESS

(75) Inventors: Jeremy Michael Evans, Calgary (CA); John D. Evans, Calgary (CA)

(73) Assignee: Evco Technology & Development Company, Ltd., Calgary (CA)

( * ) Notice: Subject to any disclaimer, the term of this patent is extended or adjusted under 35 U.S.C. 154(b) by 0 days.

(21) Appl. No.: 10/401,834

(22) Filed: Mar. 31, 2003

(65) Prior Publication Data

US 2004/0129260 A1 Jul. 8, 2004

(30) Foreign Application Priority Data

Jan. 6, 2003 (CA) ..... 2415626

(51) Int. Cl.[7] ..... F41B 5/14
(52) U.S. Cl. ..... 124/86; 124/1
(58) Field of Search ..... 124/1, 23.1, 25.6, 124/86, 80

(56) References Cited

U.S. PATENT DOCUMENTS 4,291,452 A * 9/1981 Whitman et al.
5,125,389 A 6/1992 Paff
5,425,350 A 6/1995 Egusquiza
5,746,192 A * 5/1998 Gissel
5,957,120 A * 9/1999 Wiseby et al.

* cited by examiner

*Primary Examiner*—John A. Ricci
(74) *Attorney, Agent, or Firm*—Oyen Wiggs Green & Mutala, LLP

(57) ABSTRACT

The invention provides a bow press, for use with a bow comprising a pair of resilient limbs extending outwardly in opposite directions from a central handle portion, the limbs each having an outer end. The bow press comprises first and second pulling members, a coupler, and first and second limb connectors. Each pulling member has a first end and a second end, with a threaded portion at the first end. The coupler is configured to threadedly engage the threaded portions of first and second pulling members. The first and second limb connectors are attached to the second end of the first and second pulling members, respectively, and are configured to engage the outer ends of the limbs. The threaded portions of the first and second pulling members are oppositely threaded, so that rotation of the coupler relative to the first and second pulling members in a first sense moves the pulling members closer together, and rotation of the coupler relative to the first and second pulling members in a second sense moves the pulling members farther apart.

25 Claims, 6 Drawing Sheets

PORTABLE BOW PRESS

FIELD OF THE INVENTION

This invention relates to presses for archery bows. A bow press is a device for drawing the limbs of a bow together for insertion or removal of a bow string or a bow cable.

BACKGROUND OF THE INVENTION

A modern archery bow typically comprises a central handle portion to which are attached a pair of resilient limbs. The limbs are bent out of their relaxed position and held in place by a bow string or cable or both attached between the distal ends of the limbs. The limbs maintain the bow string under tension. If the bow is a compound bow then it may include pulleys and/or cams mounted at the ends of the limbs, as is known in the art.

In a modern compound bow the bow string is typically maintained under sufficient tension, even when the bow is not drawn, that it is not easily possible by hand to take off a bow string or cable or to replace the bow string or cable with a new bow string or cable. Bow presses are used for this purpose. A bow press typically comprises a stand which holds the bow and a mechanism which draws the limbs toward each other in a degree sufficient to release the tension on the bow string. The bow press holds the bow in this configuration and permits the bow string to be removed and replaced. An example of such a bow press is disclosed in U.S. Pat. No. 5,125,389.

There also exist portable bow presses, but these are typically difficult to use, and require that the user be strong.

SUMMARY OF THE INVENTION

The invention provides a bow press, for use with a bow comprising a pair of resilient limbs extending outwardly in opposite directions from a central handle portion, the limbs each having an outer end. The bow press comprises first and second pulling members, a coupler, and first and second limb connectors. Each pulling member has a first end and a second end, with a threaded portion at the first end. The coupler is configured to threadedly engage the threaded portions of first and second pulling members. The first and second limb connectors are attached to the second end of the first and second pulling members, respectively, and are configured to engage the outer ends of the limbs. The threaded portions of the first and second pulling members are oppositely threaded, so that rotation of the coupler relative to the first and second pulling members in a first sense moves the pulling members closer together, and rotation of the coupler relative to the first and second pulling members in a second sense moves the pulling members farther apart.

The bow press may further comprise a frame, wherein the pulling members pass through apertures in the frame. The pulling members may be U-shaped. Each pulling member may comprise a shorter arm and a longer arm, and both the shorter arm and the longer arm of each pulling member passes through a separate aperture in the frame.

The apertures and cross sections of the pulling members may be non-circular. The apertures and cross sections of the pulling members may be rectangular.

The first limb connector may be adjustable in length. The first limb connector may comprise a chain. The first limb connector comprises a cable.

The bow press may further comprise a ratchet handle attached to the coupler. The coupler may comprise a pair of opposed flat surfaces for engagement by a wrench. The coupler may have a knurled outer surface.

The invention also provides a method for pulling the limbs of a bow together. The method comprises providing a first pulling member, a second pulling member, and a coupler threadedly engaging the first and second pulling members, connecting the first and second pulling members to the outer ends of the first and second limbs, respectively, and, drawing the first and second pulling members together by rotating the coupler relative to the first and second pulling members.

The method may further comprise providing a frame, wherein the pulling members pass through apertures in the frame. The method may further comprise preventing the pulling members from rotating relative to the frame.

Preventing the pulling members from rotating relative to the frame may comprise providing each pulling member with a shorter arm and a longer arm, and both the shorter arm and the longer arm of each pulling member passes through a separate aperture in the frame. Preventing the pulling members from rotating relative to the frame may comprise providing non-circular apertures in the frame and non-circular cross sections of the pulling members.

The method may further comprise providing a ratchet handle attached to the coupler, wherein rotating the coupler comprises rotating the ratchet handle.

The invention also provides a method for re-stringing a bow which incorporates the above method for pulling the limbs of a bow together.

BRIEF DESCRIPTION OF DRAWINGS

In drawings which illustrate non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
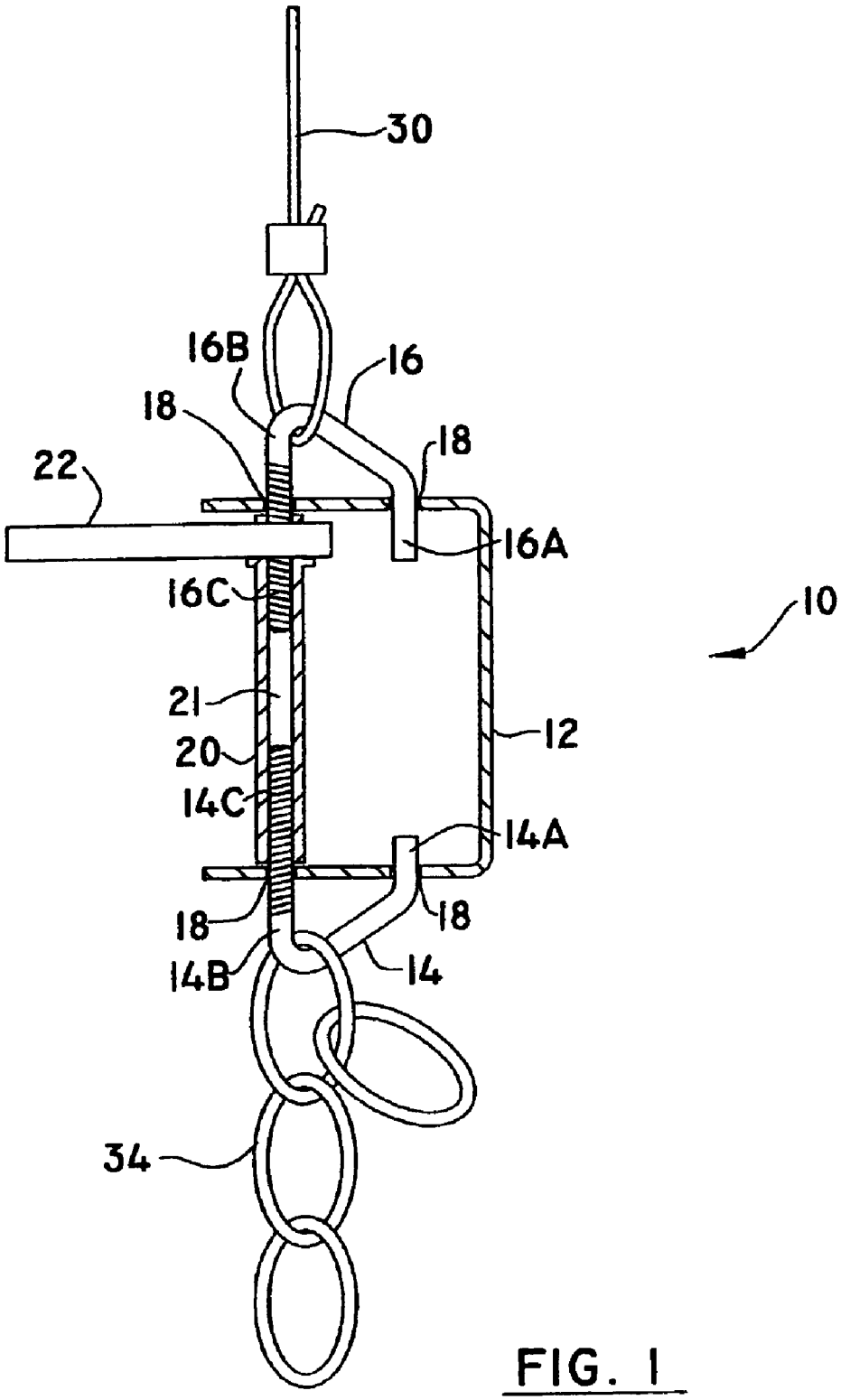
FIG. 1 shows a portable bow press according to one embodiment of the invention.

FIG. 1 shows a bow press 10 according to the invention. Bow press 10 comprises a frame 12 which non-rotationally receives pulling members 14, 16. In the illustrated embodiment, each of pulling members 14 and 16 comprises a U-shaped member which has two arms. Each of the arms passes through an aperture 18 in frame 12. Pulling member 14 has a shorter arm 14A and a longer arm 14B. Pulling member 16 has a shorter arm 16A and a longer arm 16B.

The longer arms of each of members 14 and 16 bear threaded portions 14C and 16C respectively. Threaded portion 14C is threaded in the opposite sense from threaded portion 16C. That is, if portion 14C bears a left hand thread then portion 16C bears a right hand thread, and vice-versa. Threaded portions 14C and 16C are threadedly received within the bore 21 of a coupler 20. It can be appreciated that rotating coupler 20 in a first sense will draw members 14 and 16 together. Rotating coupler 20 in a second sense, opposite to the first sense, will push members 14 and 16 apart. A reversible ratchet handle 22 maybe provided on coupler 20 to facilitate either drawing members 14 and 16 together or releasing members 14 and 16.

Each of members 14 and 16 is connected to a limb connector for connecting the member to a limb of a bow. In the illustrated embodiment, each of the limb connectors comprises a cable having a transversely oriented pin at a distal end. Cable 30 is attached to member 16. A transverse pin 32 (see FIGS. 2 and 3) is at a distal end of cable 30. Cable 33 also has a transverse pin 36 at its distal end. The other end of cable 33 is attached to a chain 34, which is connected to member 14. Pins 32, 36 facilitate attachment of the limb connectors to bow limbs that have forks or apertures in their distal ends. It is to be understood that alternative means for attaching the limb connectors, such as loops, clamps or hooks, are equally within the spirit and scope of the invention. The means for attaching the limb connectors to the bow limbs will be determined by the characteristics of the user's bow.

At least one of the limb connectors is adjustable. In the illustrated embodiment, the adjustability is provided by permitting any of several different links of chain 34 to be connected to member 14. This is facilitated by making arm 14A of member 14 somewhat shorter than arm 16A of member 16. Coupler 20 can be rotated into a release position by moving members 14 and 16 apart until arm 14A has passed through aperture 18 and is clear of frame 12. When this has been done, chain 34 can be removed from member 14 and replaced on member 14 with a different link of chain on member 14.

Figure 2:
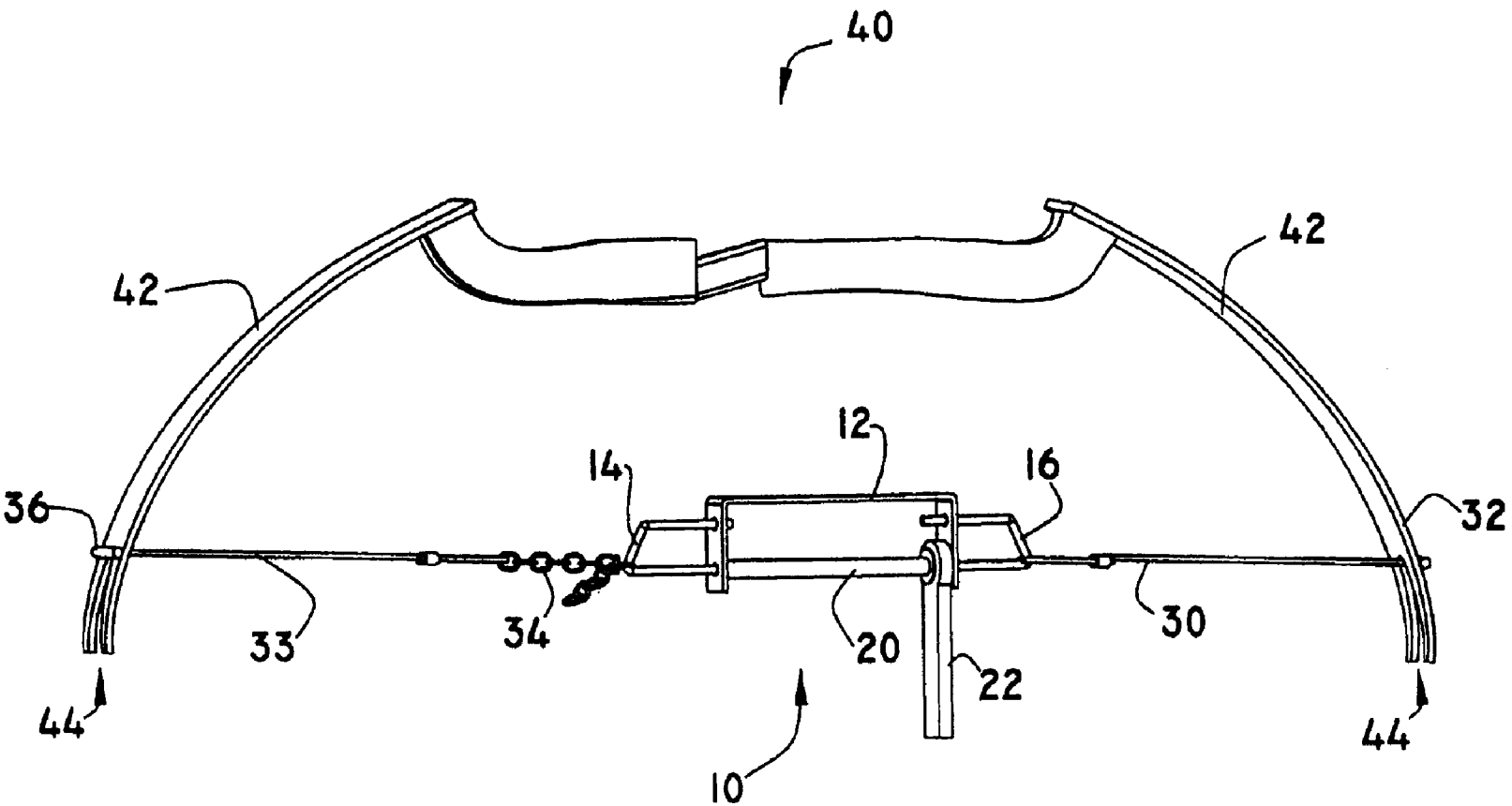
FIG. 2 shows the portable bow press applied to a bow, before it is tightened.
Figure 3:
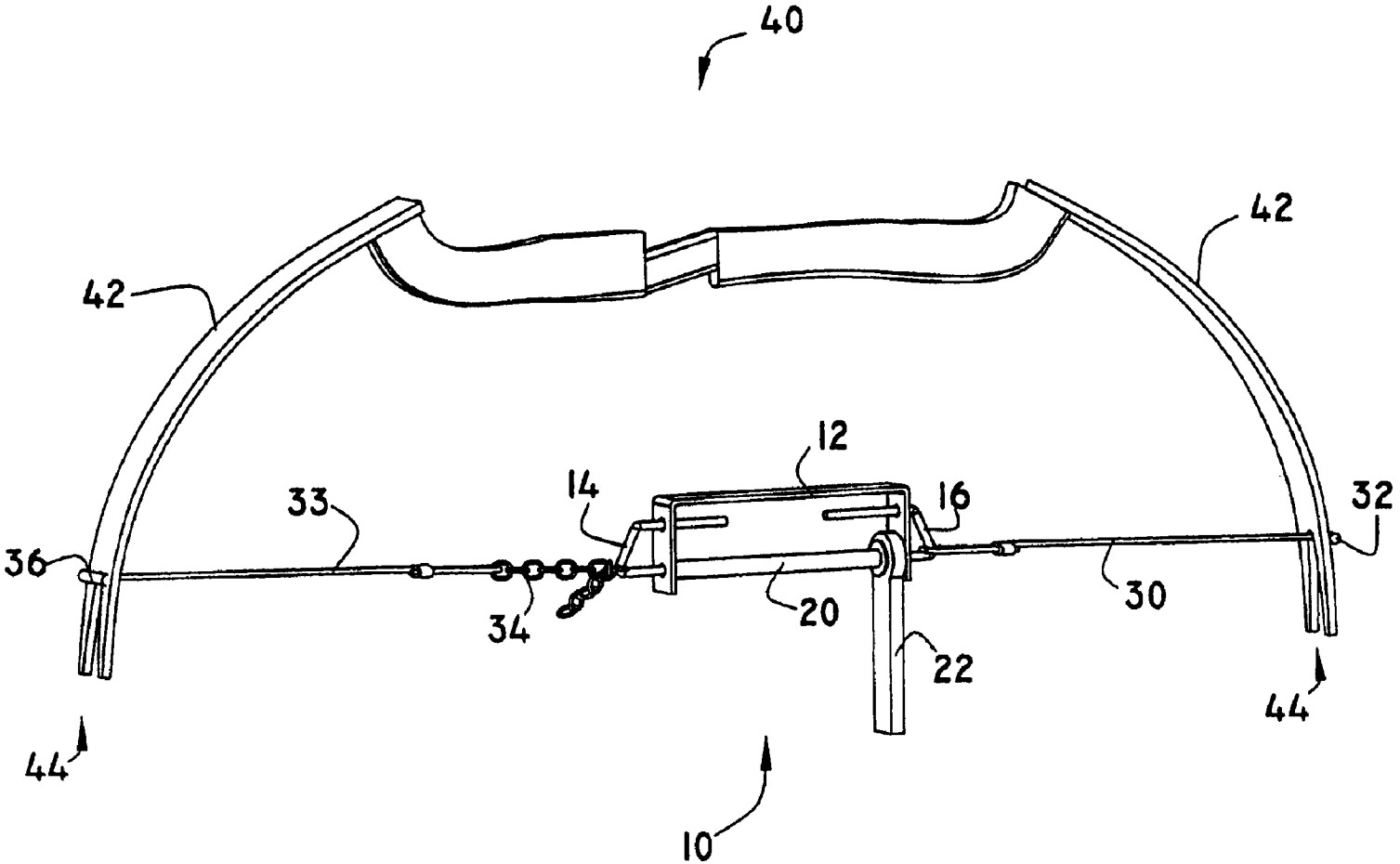
FIG. 3 shows the bow press of FIG. 2 in a tightened configuration in which the limbs of the bow have been drawn together for removal and replacement of the bow string.

As illustrated in FIG. 2, bow press 10 is adapted for use with a compound bow 40 in which each limb 42 has a fork 44 at its distal end. Pulleys and/or cam assemblies are supported between the forks 44 of each limb 42. Bow press 10 is installed by passing cable 30 through the space between fork 44 in one of limbs 42 of bow 40 and then orienting transverse pin 32 so that cable 30 cannot be pulled back through fork 44. Cable 33 is similarly connected to the other limb 42 of bow 40. This is done with coupler 20 in a release position in which the end of limb 14A has passed through aperture 18, as described above. Chain 34 is pulled tight by hand and a link of chain 34 is hooked around member 14. Then connector 20 is rotated so as to draw members 14 and 16 towards one another. This compresses limbs 42 of bow 40 toward one another, as shown in FIG. 3. Preferably bow press 10 is dimensioned to provide at least seven inches of travel as coupler 20 is rotated. This permits the limbs of most bows to be drawn together sufficiently to replace the bow string. As one skilled in the art will appreciate, bow press 10 could be adapted for use with larger or smaller bows by providing a greater or lesser travel distance, without departing from the spirit or scope of the invention.

Figure 5:
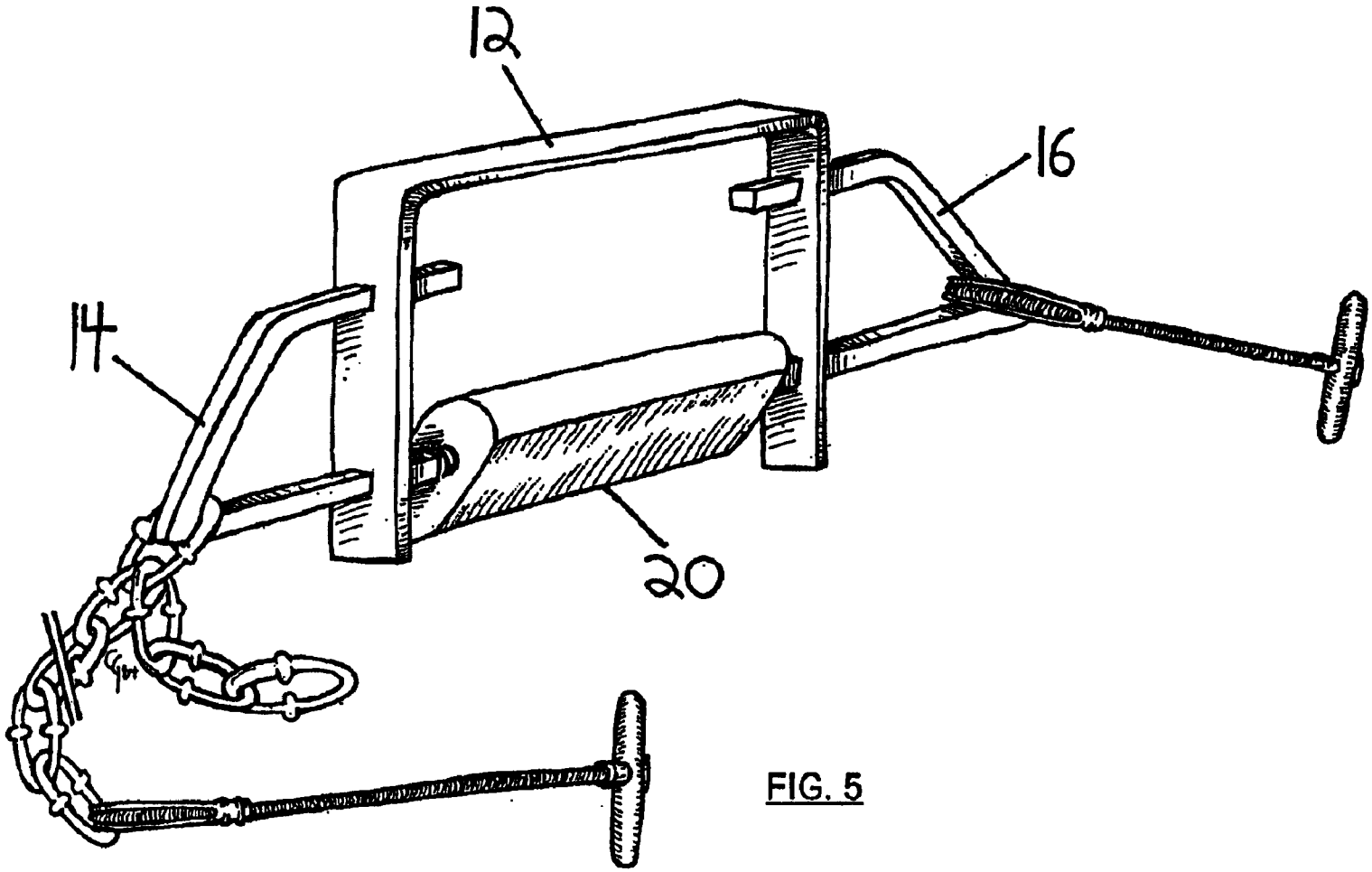
FIG. 5 shows a portable bow press according to another embodiment of the invention.
Figure 6:
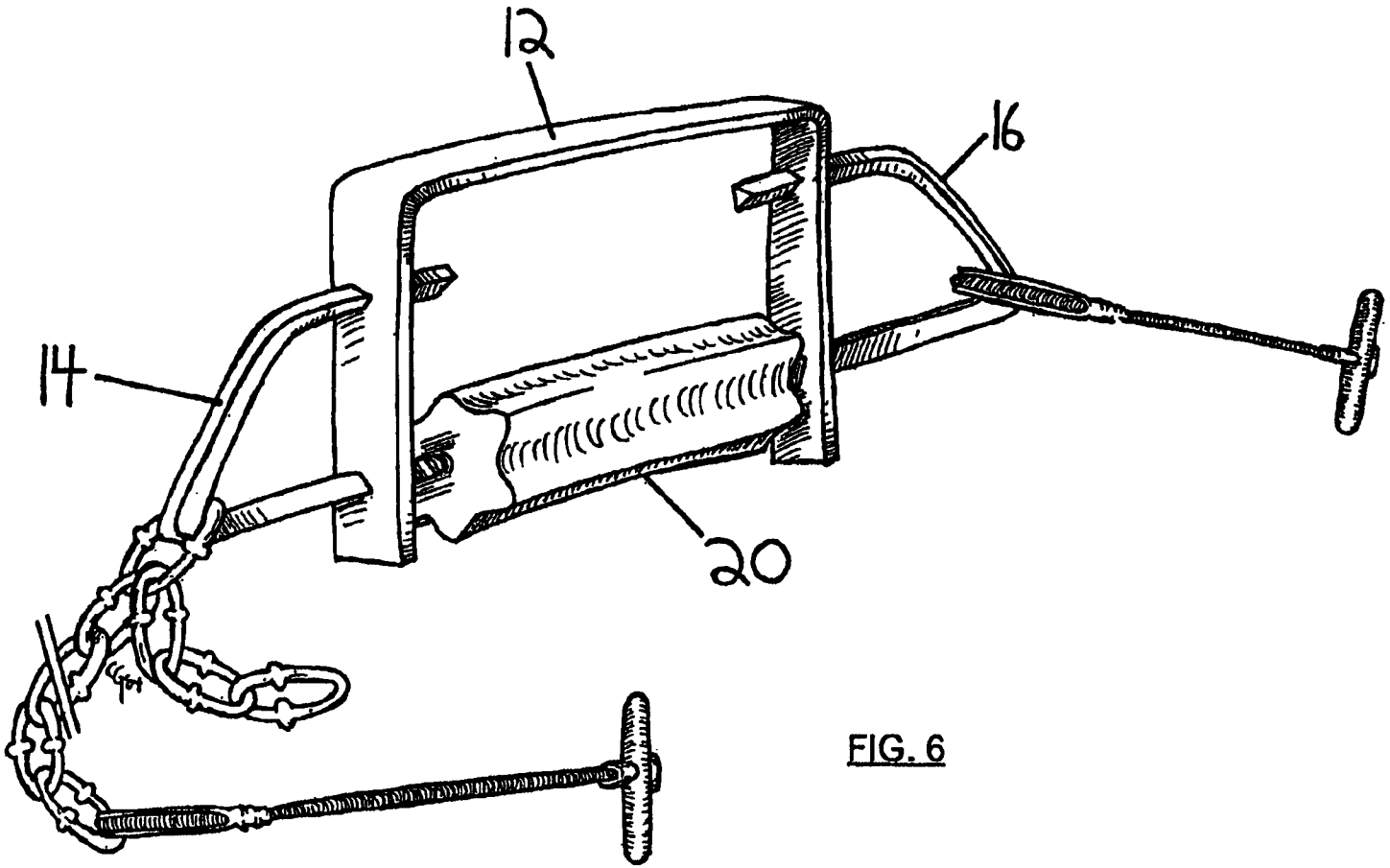
FIG. 6 shows a portable bow press according to still another embodiment of the invention.

While members 14 and 16 are prevented from rotating in the preferred embodiment which is described herein by having each member pass through a pair of apertures 18 in a frame 12, it would be possible to practice this invention by providing a bow press in which members 14 and 16 pass through only a single aperture in frame 12 and were prevented from rotating in that aperture by making both the aperture and the cross section of the member non-round. For example, the portion of members 14 and 16 which pass through frame 12 may be square and the aperture 18 through which they extends may also be square, as shown in FIG. 5. Other non-round shapes are also possible, as shown in FIG. 6.

In the embodiment shown in FIGS. 1 to 3, frame 12 has been illustrated as being generally C-shaped or U-shaped. Frame 12 could also have other configurations, for example a square or rectangle, so long as frame 12 has two opposed sides which are generally parallel.

Figure 4:
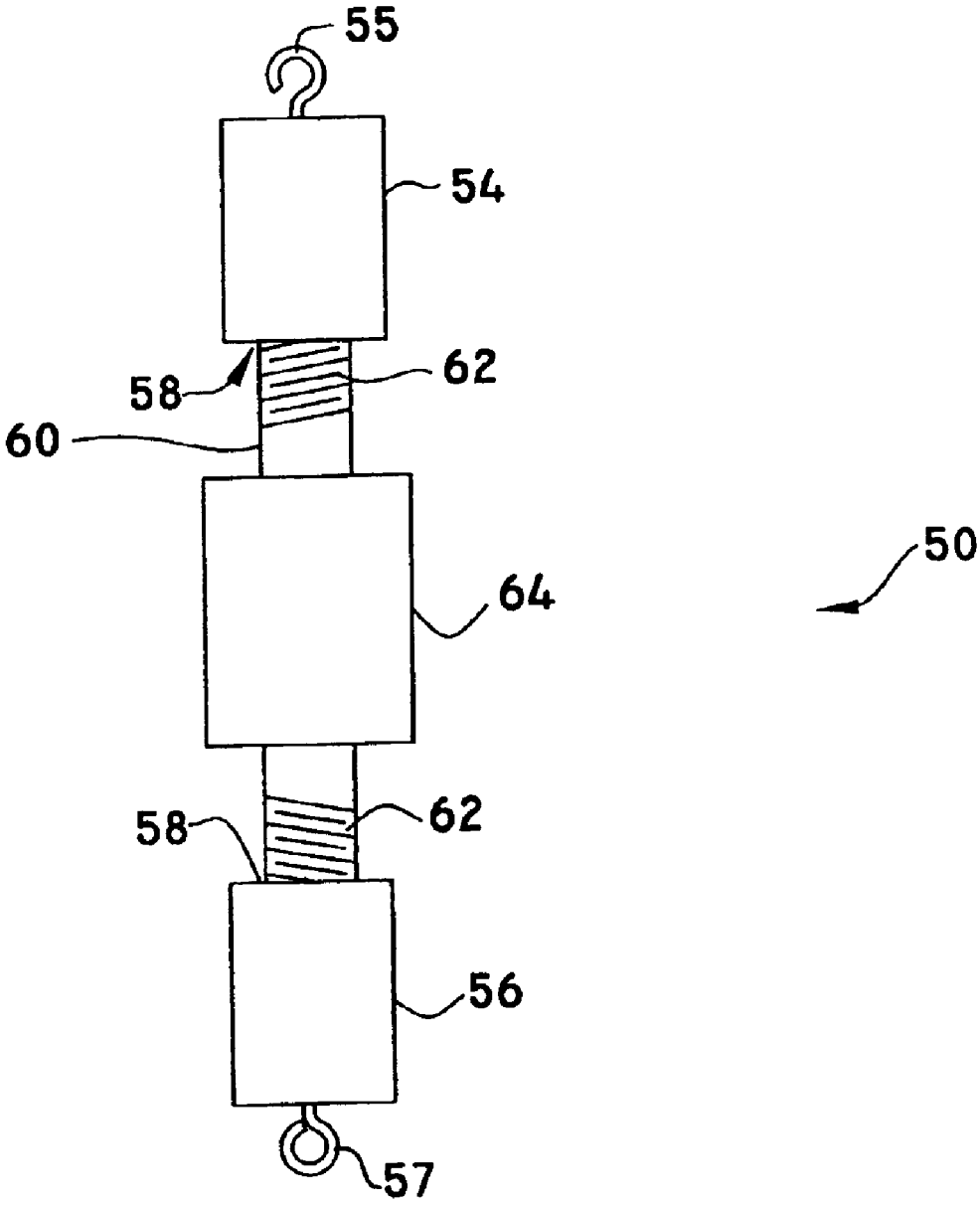
FIG. 4 shows a portable bow press according to another embodiment of the invention.

Another embodiment of the invention provides a bow press without any frame. FIG. 4 shows a bow press 50 with no frame. FIG. 4 also illustrates how pulling members 54 and 56 may have threaded sockets 58 therein, and coupler 60 has a threaded portion 62 at each end. In this embodiment, coupler 60 may comprise a grip 64, and the outer surfaces of pulling members 54 and 56 may be knurled to facilitate turning of coupler 60 relative to pulling members 54 and 56. Pulling members 54 and 56 may have a hook 55 and a loop 57, respectively thereon, to allow attachment to connecting means such as chain 34 and cable 30.

It can be appreciated from the foregoing that a bow press according to this invention may be made in a manner which is compact and easily transportable. Thus it may be carried by a bow hunter in the field.

Ratchet handle 22 is optional. An outer surface of coupler 20 may be knurled or otherwise patterned on its surface so that it can be turned by hand, as shown in FIG. 6. Where this is the case and a ratchet handle 22 is not provided then connector 20 preferably has flats on it, as shown in FIG. 5, so that it can be turned with a wrench.

The limb connectors for connecting each of members 14 and 16 to a respective limb of a bow are not limited to chains. By way of example only, one or both of these means could comprise a cable.

As will be apparent to those skilled in the art in the light of the foregoing disclosure, many alterations and modifications are possible in the practice of this invention without departing from the spirit or scope thereof. For example, the cables could be replaced by ropes, straps or the like. Accordingly, the scope of the invention is to be construed in accordance with the substance defined by the following claims.

What is claimed is:

1. A bow press, for use with a bow comprising a pair of resilient limbs extending outwardly in opposite directions from a central handle portion, the limbs each having an outer end thereof, the bow press comprising:

(a) a first pulling member, said first pulling member having a first end and a second end, with a threaded portion at the first end thereof, the first pulling member having a substantially 180 degree bend between the first and second ends such that the first and the second ends are generally parallel to one another;

(b) a second pulling member, said second pulling member having a first end and a second end, with a threaded portion at the first end thereof;

(c) a coupler configured to threadedly engage said threaded portions of first and second pulling members;

(d) a first limb connector having an aperture for receiving said second end of said first pulling member, said first limb connector and configured to engage the outer end of one of the limbs; and, (e) a second limb connector attached to said second end of said second pulling member and configured to engage the outer end of another one of the limbs, wherein the threaded portions of first and second pulling members are oppositely threaded, so that rotation of said coupler relative to said first and second pulling members in a first sense moves pulling members closer together, and rotation of said coupler relative to said first and second pulling members in a second sense moves pulling members farther apart.

2. The bow press of claim 1 further comprising a frame, wherein the pulling members pass through apertures in the frame.

3. The bow press of claim 2 wherein the pulling members are U-shaped.

4. The bow press of claim 3 wherein the second end of each pulling member comprises a shorter arm and the first end of each pulling member comprises a longer arm, and both the shorter arm and the longer arm of each pulling member passes through a separate aperture in the frame.

5. The bow press of claim 1 wherein the first limb connector is adjustable in length.

6. The bow press of claim 1 wherein the first limb connector comprises a chain.

7. The bow press of claim 1 wherein the first limb connector comprises a cable.

8. The bow press of claim 1 wherein the coupler comprises a pair of opposed flat surfaces for engagement by a wrench.

9. A bow press, for use with a bow comprising a pair of resilient limbs extending outwardly in opposite directions from a central handle portion, the limbs each having an outer end thereof, the bow press comprising:

(a) a first pulling member, said first pulling member having a first end and a second end, with a threaded portion at the first end thereof;

(b) a second pulling member, said second pulling member having a first end and a second end, with a threaded portion at the first end thereof;

(c) a frame having apertures therethrough for receiving the first and second pulling members;

(d) a coupler configured to threadedly engage said threaded portions of first and second pulling members;

(e) a first limb connector attached to said second end of first pulling member and configured to engage the outer end of one of the limbs; and, (f) a second limb connector attached to said second end of second pulling member and configured to engage the outer end of another one of the limbs, wherein the threaded portions of first and second pulling members are oppositely threaded, so that rotation of said coupler relative to said first and second pulling members in a first sense moves pulling members closer together, and rotation of said coupler relative to said first and second pulling members in a second sense moves pulling members farther apart, and wherein the apertures of the frame and cross sections of the pulling members are non-circular.

10. The bow press of claim 9 wherein the apertures and cross sections of the pulling members are rectangular.

11. The bow press of claim 9 wherein the apertures and cross sections of the pulling members are triangular.

12. A bow press, for use with a bow comprising a pair of resilient limbs extending outwardly in opposite directions from a central handle portion, the limbs each having an outer end thereof, the bow press comprising:

(a) a first pulling member, said first pulling member having a first end and a second end, with a threaded portion at the first end thereof;

(b) a second pulling member, said second pulling member having a first end and a second end, with a threaded portion at the first end thereof;

(c) a coupler configured to threadedly engage said threaded portions of first and second pulling members;

(d) a first limb connector attached to said second end of first pulling member and configured to engage the outer end of one of the limbs; and, (e) a second limb connector attached to said second end of second pulling member and configured to engage the outer end of another one of the limbs, wherein the threaded portions of first and second pulling members are oppositely threaded, so that rotation of said coupler relative to said first and second pulling members in a first sense moves pulling members closer together, and rotation of said coupler relative to said first and second pulling members in a second sense moves pulling members farther apart, the bow press further comprising a ratchet handle attached to the coupler.

13. A bow press, for use with a bow comprising a pair of resilient limbs extending outwardly in opposite directions from a central handle portion, the limbs each having an outer end thereof, the bow press comprising:

(a) a first pulling member, said first pulling member having a first end and a second end, with a threaded portion at the first end thereof, the first pulling member having a substantially 180 degree bend between the first and second ends such that the first and second ends are generally parallel to one another;

(b) a second pulling member, said second pulling member having a first end and a second end, with a threaded portion at the first end thereof;

(c) a coupler configured to threadedly engage said threaded portions of first and second pulling members;

(d) a first limb connector having an aperture for receiving said second end of said first pulling member, said first limb connector and configured to engage the outer end of one of the limbs; and, (e) a second limb connector attached to said second end of second pulling member and configured to engage the outer end of another one of the limbs, wherein the threaded portions of first and second pulling members are oppositely threaded, so that rotation of said coupler relative to said first and second pulling members in a first sense moves pulling members closer together, and rotation of said coupler relative to said first and second pulling members in a second sense moves pulling members farther apart, and wherein the coupler has a knurled outer surface.

14. A method for pulling the limbs of a bow together, the bow comprising first and second resilient limbs extending outwardly from a central handle portion, the limbs each having an outer end, the method comprising:

(a) providing a first pulling member, a second pulling member, and a coupler threadedly engaging the first and second pulling members, each of the first and second pulling members comprising a first end and a second end, with a threaded portion at the first end, and having a substantially 180 degree bend between the first and second ends such that the first and second ends are generally parallel to one another;

(b) connecting the first and second pulling members to the outer ends of the first and second limbs, respectively, by means of first and second limb connectors, each of the first and second limb connectors having an aperture, whereby the first and second pulling members are coupled to the first and second limb connectors, respectively, by inserting the second end of the first and second pulling members through the apertures; and, (c) drawing the first and second pulling members together by rotating the coupler relative to the first and second pulling members.

15. The method of claim 14 further comprising providing a frame, wherein the pulling members pass through apertures in the frame.

16. The method of claim 15 further comprising preventing the pulling members from rotating relative to the frame.

17. The method of claim 16 wherein preventing the pulling members from rotating relative to the frame comprises providing each pulling member with a shorter arm and a longer arm, and both the shorter arm and the longer arm of each pulling member passes through a separate aperture in the frame.

18. A method for pulling the limbs of a bow together, the bow comprising first and second resilient limbs extending outwardly from a central handle portion, the limbs each having an outer end, the method comprising:

(a) providing a first pulling member, a second pulling member, and a coupler threadedly engaging the first and second pulling members;

(b) providing a frame having apertures therethrough for receiving the first and second pulling members and preventing the first and second pulling members from rotating relative to the frame;

(c) connecting the first and second pulling members to the outer ends of the first and second limbs, respectively; and, (d) drawing the first and second pulling members together by rotating the coupler relative to the first and second pulling members, wherein preventing the pulling members from rotating relative to the frame comprises providing non-circular apertures in the frame and non-circular cross sections of the pulling members.

19. A method for pulling the limbs of a bow together, the bow comprising first and second resilient limbs extending outwardly from a central handle portion, the limbs each having an outer end, the method comprising:

(a) providing a first pulling member, a second pulling member, and a coupler threadedly engaging the first and second pulling members;

(b) connecting the first and second pulling members to the outer ends of the first and second limbs, respectively;

(c) drawing the first and second pulling members together by rotating the coupler relative to the first and second pulling members; and, (d) providing a ratchet handle attached to the coupler, wherein rotating the coupler comprises rotating the ratchet handle.

20. A method for re-stringing a bow, the bow comprising first and second resilient limbs extending outwardly from a central handle portion, the limbs each having an outer end, the method comprising:

(a) providing a bow string;

(b) providing a first pulling member, a second pulling member, and a coupler threadedly engaging the first and second pulling members, each of the first and second pulling members comprising a first end and a second end, with a threaded portion at the first end, and having a substantially 180 degree bend between the first and second ends such that the first and second ends are generally parallel to one another;

(c) connecting the first and second pulling members to the outer ends of the first and second limbs, respectively, by means of first and second limb connectors, each of the first and second limb connectors having an aperture, whereby the first and second pulling members are coupled to the first and second limb connectors, respectively, by inserting the second end of the first and second pulling members through the apertures;

(d) drawing the first and second pulling members together by rotating the coupler relative to the first and second pulling members until the outer ends of the limbs are separated by a distance equal to a length of the bow string; and, (e) attaching the bow string to the outer ends of the limbs.

21. The method of claim 20 further comprising providing a frame, wherein the pulling members pass through apertures in the frame.

22. The method of claim 21 further comprising preventing the pulling members from rotating relative to the frame.

23. The method of claim 22 wherein the first end of each of the first and second pulling members comprises a longer arm, and the second end of each of the first and second pulling members comprises a shorter arm, and wherein preventing the pulling members from rotating relative to the frame comprises passing both the shorter arm and the longer arm of each pulling member passes through a separate aperture in the frame.

24. The method of claim 22 wherein preventing the pulling members from rotating relative to the frame comprises providing non-circular apertures in the frame and non-circular cross sections of the pulling members.

25. The method of claim 20 further comprising providing a ratchet handle attached to the coupler and wherein rotating the coupler comprises rotating the ratchet handle.

* * * * *